United States Patent [19]

Davis

[11] Patent Number: 4,911,341

[45] Date of Patent: Mar. 27, 1990

[54] NEEDLE THREADING DEVICE HAVING A NEEDLE RECEIVING BORE WITH AN INSERTABLE ACTUATOR

[76] Inventor: Alan Davis, 18 High St., Port Washington, N.Y. 11050

[21] Appl. No.: 278,837

[22] Filed: Dec. 1, 1988

[51] Int. Cl.[4] ..... D05B 87/02

[52] U.S. Cl. ..... 223/99

[58] Field of Search ..... 223/99

[56] References Cited

U.S. PATENT DOCUMENTS

| | | | |
|---|---|---|---|
| 2,507,370 | 5/1950 | Edwards | 223/99 |
| 2,518,287 | 8/1950 | Costello | 223/99 |
| 2,625,307 | 1/1953 | Pinkham et al. | 223/99 |
| 2,656,956 | 10/1953 | Kahn | 223/99 |
| 2,679,959 | 6/1954 | Von Ullisperger et al. | 223/99 |
| 2,777,623 | 1/1957 | Balzer | 223/99 |
| 2,800,262 | 7/1957 | Appel | 223/99 |
| 4,557,408 | 12/1985 | Biemans | 223/99 |

FOREIGN PATENT DOCUMENTS

| | | | |
|---|---|---|---|
| 1465696 | 2/1977 | United Kingdom | 223/99 |

*Primary Examiner*—Andrew M. Falik

*Attorney, Agent, or Firm*—Burgess, Ryan and Wayne

[57] ABSTRACT

A needle threading device includes a rectangular block housing including a chamber at a lower end thereof which opens through a side wall. A needle receiving bore extends through a top wall of the housing for receiving a needle; and a V-shaped recess at the lower end of the needle receiving bore aligns the needle with a predetermined orientation. A thread receiving notch in the housing adjacent to the needle receiving bore receives a thread to be inserted through an eye of the needle when the needle is in the needle receiving bore. An actuator is slidably positioned in the chamber for pushing the thread in the thread receiving notch through the eye of the needle in the needle receiving bore. The actuator includes a block slidable with the chamber and a mandrel secured to an upper end of the block and extendible through a tunnel which connects the chamber with the lower end of the thread receiving notch, through another tunnel which connects the lower end of the thread receiving notch with the lower end of the needle receiving bore so as to push the thread from the thread receiving notch through the eye of the needle in the needle receiving bore and then through a tunnel which connects the lower end of the needle receiving bore to the outside of the device whereby a person can grasp the thread so as to pull the thread through the eye of the needle to a desired length.

3 Claims, 3 Drawing Sheets

NEEDLE THREADING DEVICE HAVING A NEEDLE RECEIVING BORE WITH AN INSERTABLE ACTUATOR

BACKGROUND OF THE INVENTION

This invention relates generally to the threading of needles and, more particularly, is directed to a needle threading device for accomplishing the same.

It is a common frustration to many people to thread a needle. This is because the eye of the needle is extremely small, which is necessary for using the needle in a sewing operation, combined with the fact that the thread is also of a small diameter and it is difficult to avoid having a frayed end of the thread. Accordingly, threading of a needle can often times take upwards of fifteen minutes to one half hour.

OBJECTS AND SUMMARY OF THE INVENTION

Accordingly, it is an object of the present invention to provide a needle threading device that overcomes the aforementioned problems.

It is another object of the present invention to provide a needle threading device that is relatively simple to use.

It is yet another object of the present invention to provide a needle threading device with which a needle can be threaded within a time period less than about fifteen seconds.

It is yet another object of the present invention to provide a needle threading device which is inexpensive to manufacture and use.

In accordance with an aspect of the present invention, a needle threading device includes a housing; needle receiving means in the housing for receiving a needle; needle aligning means in the housing for aligning the needle with a predetermined orientation; thread receiving means in the housing for receiving a thread to be inserted through an eye of the needle when the needle is in the needle receiving means; and actuator means in the housing for pushing the thread in the thread receiving means through the eye of the needle in the needle receiving means.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
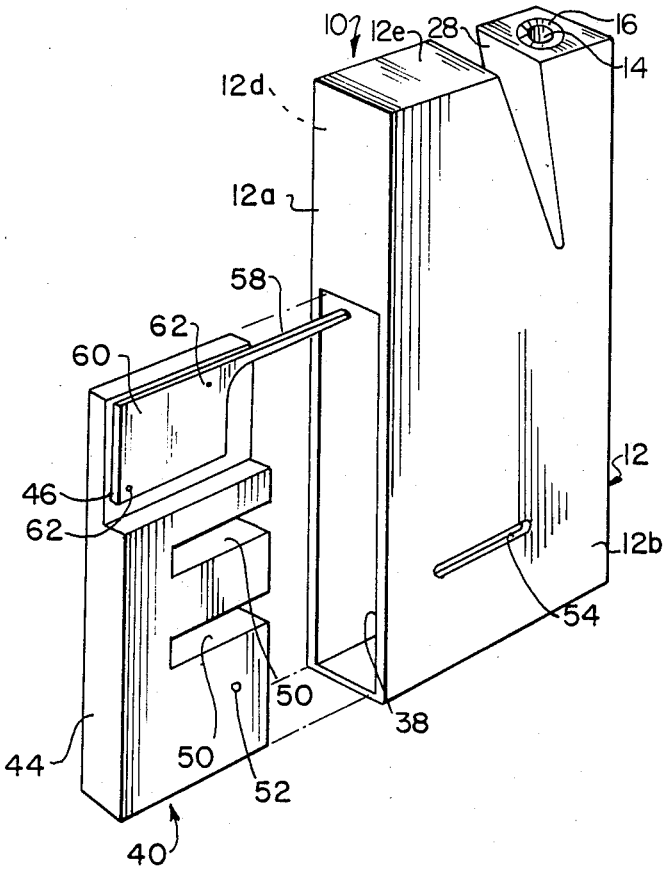
FIG. 1 is a blown-apart perspective view of a needle threading device according to the present invention.

Referring to the drawings in detail, a needle threading device 10 according to the present invention includes a generally rectangular housing 12 with side walls 12a-12d, top wall 12e and bottom wall 12f.

A needle receiving bore 14 extends vertically through top wall 12e of housing 12 at one end of top wall 12e. Needle receiving bore 14 has a height of approximately ⅓ of the height of housing 12. The entrance 16 to needle receiving bore 14 is beveled, the bore is elliptically shaped to facilitate easy insertion of the needle 18 therein and also facilitate proper alignment of the needle.

As shown best in FIGS. 4–8, the lower end of needle receiving bore 14 includes a needle aligning section 20. Specifically, needle aligning section 20 includes a V-shaped recess 22 which receives and holds the head 24 of needle 18 in the alignment shown such that the axis of the eye 26 of head 24 is substantially parallel with side walls **12*b* and 12*d* of housing 12. However, the depth of V-shaped recess 22 is sufficiently small such that the major portion of eye 26 of needle 18 is exposed above V-shaped recess 22. A V-shaped notch 28 extends through top wall 12*e* of housing 12 and extends along the entire width of housing 12 such that the lower end of notch 28 is positioned at the same height as eye 26 of needle 18. V-shaped notch 28 constitutes thread receiving means for receiving a thread 30 to be inserted into needle 18. In this manner, a tunnel 32 is provided in housing 12 so as to provide the lower end of V-shaped notch 28 in communication with the lower end of needle receiving bore 14. In this manner, as will be discussed hereinafter, thread 30 can be pushed through tunnel 32 and then through the eye 26 of needle 18**.

The lower approximate two thirds height of housing 12 is hollow so as to define a chamber 34 therein. Chamber 34, as shown best in FIG. 2, extends at a lower position then V-shaped notch 28 and V-shaped recess 22 at the respective side of housing 12, but extends to a higher height immediately adjacent V-shaped notch 28 and needle receiving bore 14. In this manner, a second tunnel 36 is provided in housing 12 to provide the lower end of V-shaped notch 28 in communication with chamber 34. Chamber 34 is open to the outside through a rectangular opening 38 in side wall **12*a***.

In this regard, an actuator 40 is slidably retained within chamber 34 so as to push thread 30 through tunnel 32 and eye 26 of needle 18. In addition, it will be appreciated that the lower end of needle receiving bore 14 is in communication with the outside of needle threading device 10 through another tunnel 42 on the opposite side of needle 18 and which extends through side wall **12*c***.

Actuator 40 is formed by a substantially rectangular block 44 having height and width dimensions slightly smaller than that of opening 38 and chamber 34 so as to be slidably received therein. Block 44 is cut away at its upper end and in the longitudinal direction so as to provide a reduced width section 46 which occupies approximately ½ the width of block 44.

In order to slidably guide block 44 in chamber 34, two inner guide walls 48 are provided in substantially parallel relation and extend in chamber 34 from the inner surface of side wall 12c toward opening 38 in side wall **12*a*. In corresponding manner, rectangular block 44 is provided with corresponding slots 50 for receiving guide walls 48 as best shown in FIG. 2 so as to slidably guide rectangular block 44 within chamber 34**.

Figure 2:
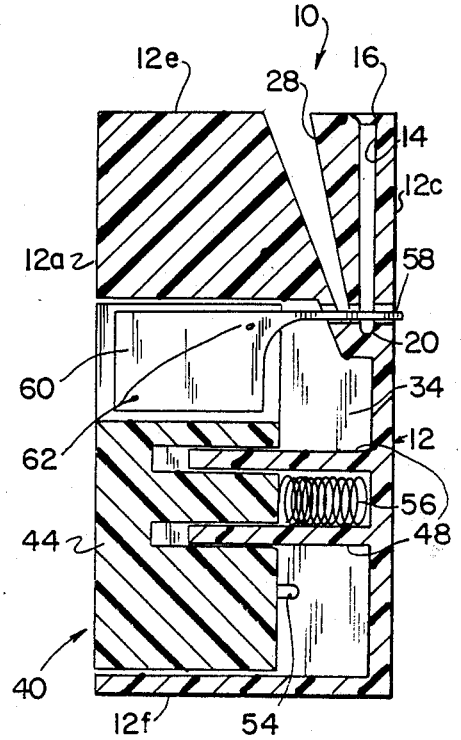
FIG. 2 is a longitudinal cross-sectional view of the needle threading device of FIG. 1.
Figure 3:
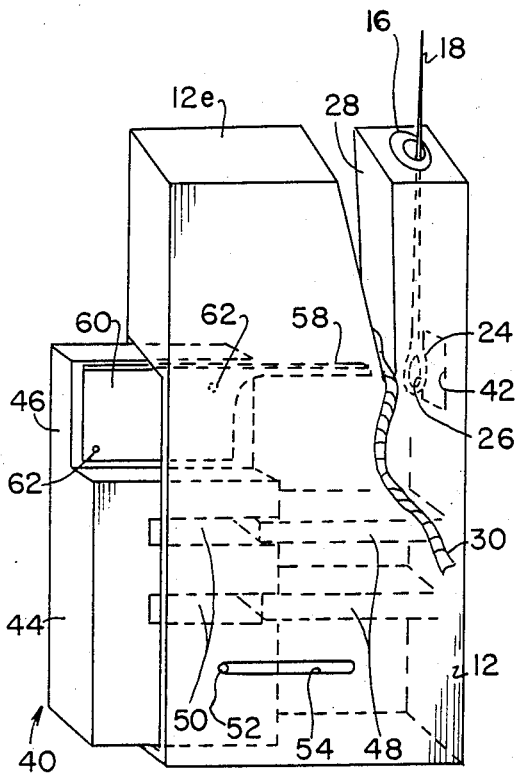
FIG. 3 is a perspective view of the needle threading device of FIG. 1 in an assembled condition, in the first step of operation.
Figure 4:
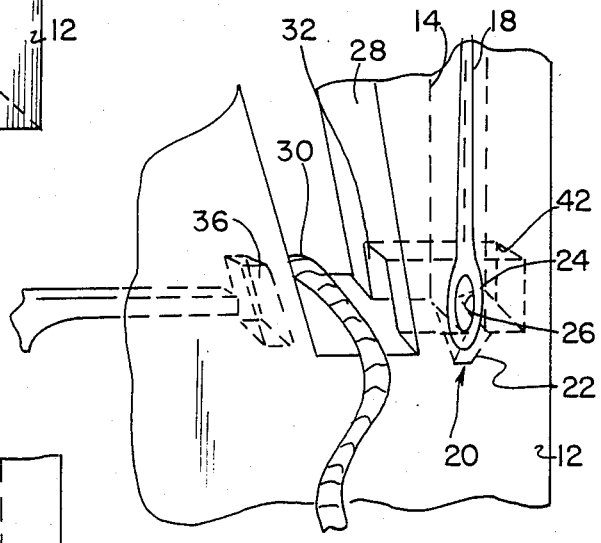
FIG. 4 is an enlarged perspective view of a portion of the needle threading device of FIG. 3.

Further, as shown in FIGS. 1–3, opposite sides of rectangular block 44 are provided with guide pins 52 which are inserted within guide slots 54 at opposite side walls **12*b* and 12*d* so as to limit the extend of sliding motion of actuator 40 in chamber 34 and to prevent the escape of actuator 40 completely from chamber 34. In this manner, actuator 40 is limited from traveling between a first limit position shown in FIG. 3 and a second limit position at which thread 30 is pushed through eye 36 of needle 18. Normally, in the absence of an external force, actuator 40 is in the position of FIG. 3 due to a coil spring 56 positioned between guide walls 48 and which biases actuator 40 to the left of FIG. 2, that is, into the position shown in FIG. 3**.

Actuator 40 further includes a mandrel 58 formed at one edge of a plate 60 which is secured to a side wall of reduced width section 46 by any suitable means such as screws 62 or the like.

When actuator 40 is slidably fit within chamber 34, mandrel 58 is at a height which permits it to extend through tunnel 36, V-shaped notch 28, tunnel 32, needle receiving bore 14 and eye 26 of needle 18, and tunnel 42. In this manner, as shown by the action FIGS. 4–7, the user merely pushes actuator 40 into chamber 34 against the force of coil spring 56, whereby mandrel 58 pushes thread 30 in V-shaped notch 28 through eye 26 of needle 18 and out of housing 12 through tunnel 42. Thereafter, the user merely pulls one portion of thread 30 through eye 26 of needle 18 so that the free end of thread 30 extends outside of housing 12. Thereafter, the user can pull a desired length of thread through tunnel 32, eye 26 and tunnel 42, whereupon the thread extending into notch 28 can be cut. Then, when needle 18 is removed from needle receiving bore 14, the thread 30 has been looped therethrough and accordingly, the needle has been threaded.

It will be appreciated that the present invention provides an extremely simplified device for threading a needle. In the first place, the V-shaped recess 22 aligns needle 18 therein in the correct angular orientation such that eye 26 of needle 18 is in alignment with mandrel 58 for receiving the same. Basically, when needle 18 is dropped through needle receiving bore 14, head 24 thereof contacts V-shaped recess 22 and due to the needles smooth, rounded surface and its weight, needle 18 will rotate on its axis until it rests with its flatter surfaces at right angles to mandrel 58 that is, with eye 26 facing mandrel 58.

Figure 5:
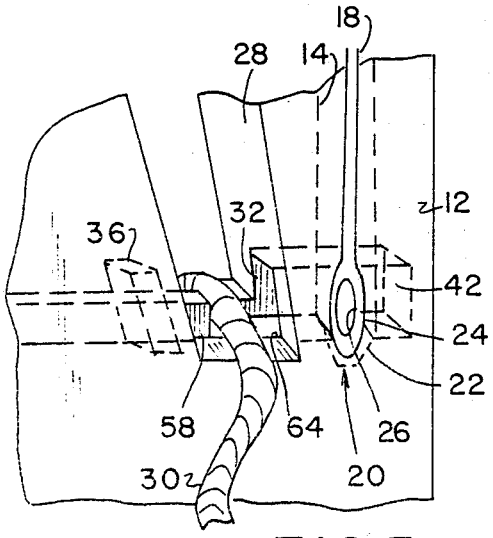
FIG. 5 is a perspective view similar to that of FIG. 4, showing the actuator beginning to push the thread towards the needle.
Figure 6:
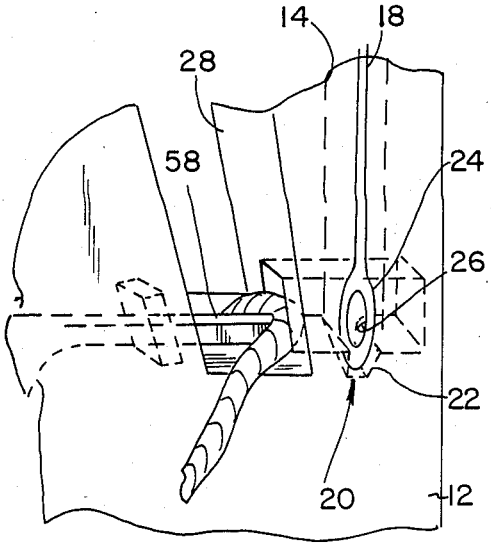
FIG. 6 is a perspective view similar to FIG. 4, showing the actuator further pushing the thread toward the needle.
Figure 7:
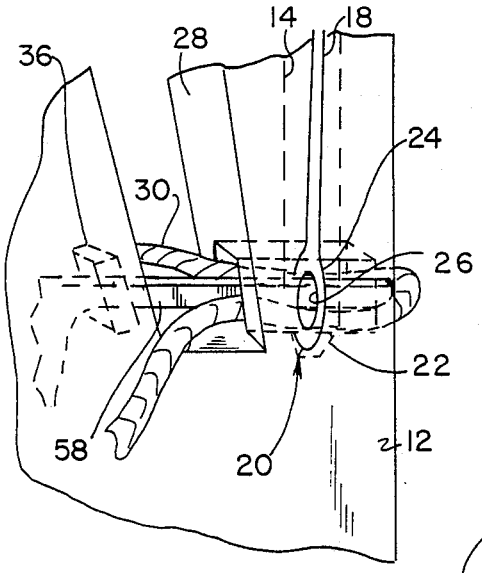
FIG. 7 is a perspective view similar to FIG. 4, showing the actuator pushing the thread through the eye of the needle.
Figure 8:
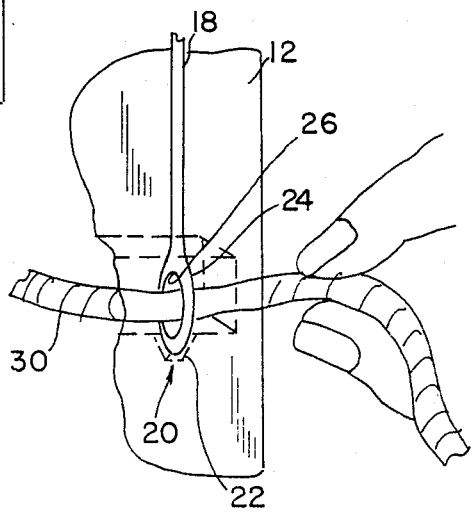
FIG. 8 is an enlarged perspective view, of a portion of the needle threading device of FIG. 3, showing a person pulling the remainder of the free end of the thread through the eye of the needle.

It is noted, as shown only in FIG. 5, that a groove 64 or the like can be provided at the lower end of V-shaped notch 28 for further guiding mandrel 58 therethrough.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined by the appended claims.

What is claimed is:

1. A needle threading device comprising;

a housing including a lower chamber;

needle receiving bore means in the housing at a height above said chamber for receiving a needle; needle aligning means in the needle receiving bore means for aligning the needle with a predetermined orientation;

thread receiving notch means in the housing adjacent to the needle receiving bore means for receiving a thread to be inserted through an eye of the needle when the needle is in the needle receiving bore means;

first tunnel means in said housing for providing communication with a lower end of said needle receiving bore means at one side thereof;

second tunnel means in said housing for providing communication between a lower end of said thread receiving notch means and the lower end of the needle receiving bore means at an opposite side thereof;

third tunnel means in the housing for providing communication between the lower end of the thread receiving notch means and the chamber;

actuator means in said housing for pushing the thread in said thread receiving notch means through the eye of the needle in the needle receiving bore means, said actuator means including a block slidably received within said chamber and mandrel means secured to the block and pushable through said third tunnel means, the lower end of said thread receiving notch means, said second tunnel means, the lower end of said needle receiving bore means and said first tunnel means for pushing a thread at the lower end of the thread receiving notch means through the eye of the needle; and further including biasing means for normally biasing said actuator means in a direction out of said chamber.

2. A needle threading device according to claim 1; further including restraining means for limiting movement of said actuator means in said chamber.

3. A needle threading device according to claim 1; further including guide means for guiding movement of said actuator means in said chamber.

* * * * *